US009084061B2

(12) United States Patent
Griesdorf et al.

(10) Patent No.: US 9,084,061 B2
(45) Date of Patent: Jul. 14, 2015

(54) METHOD AND SYSTEM FOR IMPROVING QUALITY OF AUDIO SOUND

(75) Inventors: Dustin Griesdorf, Waterloo (CA); Chris Beg, Kitchener (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 604 days.

(21) Appl. No.: 13/569,970

(22) Filed: Aug. 8, 2012

(65) Prior Publication Data

US 2014/0044272 A1 Feb. 13, 2014

(51) Int. Cl.
*H04R 29/00* (2006.01)
*H04R 25/00* (2006.01)

(52) U.S. Cl.
CPC ..... *H04R 25/30* (2013.01); *H04R 25/505* (2013.01)

(58) Field of Classification Search
CPC ..... H04R 25/30; H04R 25/505
USPC ..... 381/60, 312, 23.1
See application file for complete search history.

(56) References Cited

U.S. PATENT DOCUMENTS

| | | | | |
|---|---|---|---|---|
| 6,940,343 | B2 | 9/2005 | Heubi et al. | |
| 7,205,918 | B2 * | 4/2007 | Niederdrank et al. | 341/143 |
| 7,336,794 | B2 | 2/2008 | Furst et al. | |
| 2003/0081803 | A1 | 5/2003 | Petilli et al. | |

* cited by examiner

*Primary Examiner* — Paul S Kim
(74) *Attorney, Agent, or Firm* — Robert F. Hightower

(57) ABSTRACT

In one embodiment, a method and system includes: synchronizing the timing of the change of a clock frequency based on the state of an output subsystem for driving an output transducer.

18 Claims, 14 Drawing Sheets

METHOD AND SYSTEM FOR IMPROVING QUALITY OF AUDIO SOUND

BACKGROUND

1. Field of Invention

The present invention relates, in general, to signal processing, and more specifically to a method and system for improving quality of audio sound.

2. Background

Hearing aids and similar listening devices typically include a DSP having hearing aid algorithms, a sigma-delta modulator, a H-bridge output driver, and a hearing aid transducer. The DSP runs from an internal oscillator at some configured frequency that is typically in the range of 1 to 10 MHz but may be higher or lower. The sigma-delta modulator is clocked from the internal oscillator. The sigma-delta modulator is used to generate modulated signals from a baseband audio signal. The H-bridge output driver outputs a pulse width modulated (PWM) signal used to drive the hearing aid transducer.

The problem occurs when an algorithm running on the DSP needs to increase the configured operating frequency. This may occur when the algorithm requires more processing cycles to complete its computation. One option for the algorithm would be to always run at the fastest required frequency. However the use of the fastest required frequency has the negative side effect of increased power consumption, even then it is not necessary, which may be unacceptable for battery powered devices (e.g., hearing aids or other listening devices).

Alternative option for the algorithm may be to increase and subsequently decrease the operating frequency in real-time (known as "clock throttling"). When a clock throttling event occurs, there is a potential for the PWM output signal going to the hearing aid transducer to become corrupt. The PWM output signal may become corrupt because the internal oscillator's clock period changes in such a way that cannot be compensated with through typical digital clock dividers. The corrupted PWM output signal results in an audio artifact audible to the hearing aid user. The artifact has been described as a 'click' or 'pop' sound. Such artifact is undesirable.

A hearing aid DSP being a low power device typically contains a basic free-running RC oscillator circuit for generating the clock and minimizing power consumption. When the frequency of the clock changes, the oscillator may lack phase compensation to save power and thus the generated clock is subjected to a potential phase error during the oscillator adjustment. Such a phase error can cause audio artifacts. To reducing the audio artifacts, the DSP's internal oscillator itself may be improved. However, the problem may occur because the internal oscillator will transition from the high-to-low or low-to-high operating frequency in a non-zero amount of time. During this transition event a PWM output signal must remain coherent. The clock period between edge transitions needs to remain constant to eliminate the artifact.

Accordingly, it is desirable to have a method and system that allows for clock frequency changes without inducing audio artifacts.

Figure 1:
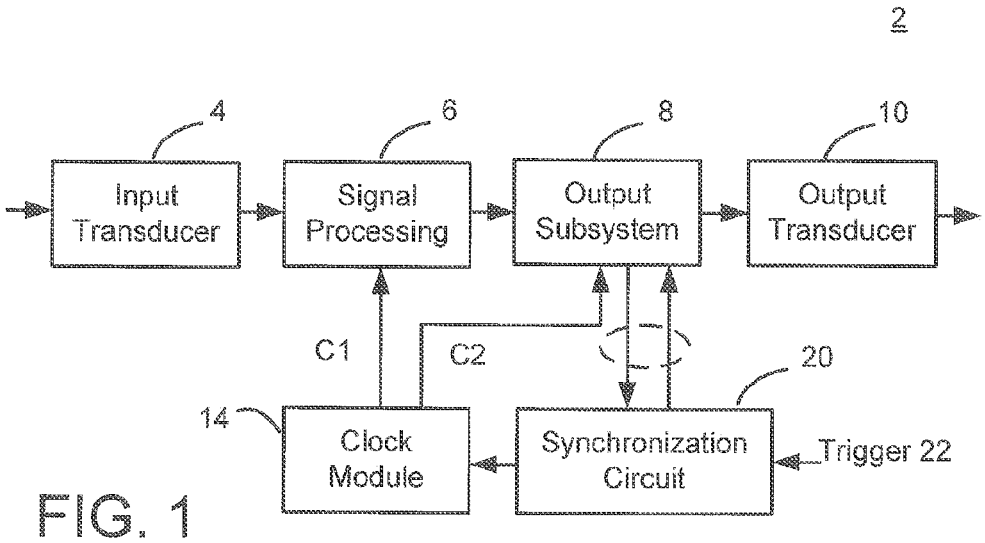
FIG. 1 is a block diagram illustrating a system having a synchronization circuit with feedback mechanism for adjusting operation clocks of the system in accordance with an embodiment of the present invention.

For simplicity and clarity of the illustration, elements in the figures are not necessarily to scale, are only schematic and are non-limiting, and the same reference numbers in different figures denote the same elements, unless stated otherwise. Additionally, descriptions and details of well-known steps and elements are omitted for simplicity of the description. It will be appreciated by those skilled in the art that the words "during", "while", and "when" as used herein relating to circuit operation are not exact terms that mean an action takes place instantly upon an initiating action but that there may be some small but reasonable delay, such as a propagation delay, between the reaction that is initiated by the initial action. Additionally, the term "while" means that a certain action occurs at least within some portion of a duration of the initiating action. The use of the word "approximately" or "substantially" means that a value of an element has a parameter that is expected to be close to a stated value or position. However, as is well known in the art there are always minor variances that prevent the values or positions from being exactly as stated. When used in reference to a state of a signal, the actual voltage value or logic state (such as a "1" or a "0") of the signal depends on whether positive or negative logic is used. Herein, a positive logic convention is used, but those skilled in the art understand that a negative logic convention could also be used. The terms "first", "second", "third" and the like in the Claims or/and in the Detailed Description, are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION

The present description includes, among others, a method of improving quality of audio sound, which includes, for example,: monitoring the state of an output subsystem for driving an output transducer based on a system clock, the output transducer for outputting audio sound; monitoring an event affecting the frequency of the system clock; and in response to the event, synchronizing the timing of the change of the clock frequency based on the state of the output subsystem to reduce or eliminate audio artifacts. The present disclosure further includes, among others, a system for improving quality of audio sound, which includes, for example,: a synchronization circuit for monitoring the state of an output subsystem for driving an output transducer based on a system clock, the output transducer for outputting audio sound, and for, in response to an event affecting the frequency of the system clock, synchronizing the timing of the change of the clock frequency based on the state of the output subsystem to reduce or eliminate audio artifacts. The system may be formed on a semiconductor substrate. The present disclosure further includes, among others, a computer readable storage medium storing one or more programs, the one or more programs comprising instructions, which when executed, cause a system to perform the method. The computer readable storage medium may be formed on a semiconductor substrate.

Referring to FIG. 1, there is illustrated an example of a system 2 for producing audio sound. The listening system 2 includes an input transducer 4, an output transducer 10, and a clock manager for controlling an operation clock of the system 2. In a non-limiting example, the listening system 2 is a hearing aid for compensating for hearing loss of a hearing aid's user. The input transducer 4 includes, for example, a microphone, an array of microphones, an analog to digital (A/D) converter, a storage medium, and/or any other input transducer elements for digital hearing aid applications. The output transducer 10 includes, for example, an earpiece, a speaker, and/or any other output transducer elements for digital hearing aid applications. An input signal captured by the input transducer 4 is converted into an electrical signal, and is processed in a signal path including a signal processing module 6 and an output subsystem 8. The signal processing module 6 includes, for example, a memory and a digital signal processor (DSP). The signal processing module 6 may process its inputs to reduce audible noise, add gain, or similarly improve the audio quality for the hearing aid user. Digital signals output from the signal processing module 6 are converted into analog signals by the output subsystem 8. The output subsystem 8 drives the output transducer 10 based on the outputs of the signal processing module 6.

The output subsystem 8 employs one or more driving schemes (or one or more output modes) for driving the output transducer 10. The output subsystem 8 generates, for example, a series of pulses by alternating between 2 output states, 3 output states, or other number of output states. The driving scheme of the output subsystem 8 may be programmable. In the description, the terms "driving scheme", "output mode" and "output state" may be used interchangeably. In a non-limiting example, the output subsystem 8 includes an output modulator and an output driver or converter. The output modulator may include a PWM or sigma-delta modulator for generating sigma-delta modulated (bit) streams. The output driver may include a H-bridge driver driven by the outputs of the modulator (e.g., a class D power converter).

The clock manager of the system 2 includes a clock module 14 and a synchronization circuit 20. The clock module 14 includes an oscillator for providing the system 2 clock including a clock C1 for the signal processing module 6 and a clock C2 for the output subsystem 8. The oscillator may be a RC oscillator. The frequency of the clock generated by the clock module 14 can be changed.

The synchronization circuit 20 observes or monitors the state of the output subsystem 8. In response to a trigger 22, the synchronization circuit 20 synchronizes the clock frequency change event of the system 2, depending on the state information or the state of the output subsystem 8. The synchronization of the clock frequency change event includes, for example, changing the timing of the clock change event, modifying the state of the output subsystem, or a combination thereof such that it improves audio performance including, for example, reducing or eliminating audio artifacts induced by dynamically changing the clock frequency, and/or improving power consumption performance of the signal processing module 6 (e.g., DSP) depending on the processing load. The state information or the state of the output subsystem 8 include, for example, an output from a modulator coupling to an output driver or a converter, an input to the output driver or the converter driving the transducer 10, or the internal state of the output driver or the converter.

The trigger 22 is an event which may have an effect on the performance of the output subsystem 8. The trigger 22 may be initiated internally or externally. In a non-limiting example, the trigger 22 is an internally initiated trigger related to an event for explicitly changing the clock (e.g., clock throttling) where artifacts may occur due to the change of the clock frequency. In a non-limiting example, the trigger 22 is to change the system clock that affects C1, C2, or both of C1 and C2. In a further non-limiting example, the trigger 22 is an externally initiated trigger related to an event where the oscillator characteristics change due to some other external event. In a further non-limiting example, the trigger 22 is an event affecting a power supply, and the performance of the oscillator in the clock module 14 depends on the power supply. The synchronization circuit 20 will reduce subsequent artifacts arising from the resulting change in the oscillator period.

In FIG. 1, one input transducer 4, one signal processing module 6, one output subsystem 8, one output transducer 10, and one clock module 14 are shown for illustration purposes only. The number of these elements in the system 2 may vary. In a non-limiting example, the system 2 includes more than one output subsystems, each output subsystem 8 having an independent modulator (i.e. a stereo output system or similar) where the output data streams from the modulators are independent. The synchronization circuit 20 observes or monitors all of the outputs of the output subsystems and either waits until they are all in a certain state or modifies one or more output subsystem outputs. In a non-limiting example, the system 2 may include multiple clocks, each operating independently. The system 2 may include components not illustrated in FIG. 1.

It would be appreciated by one of ordinary skill in the art that the synchronization scheme in the system 2 may be employed in any devices such as a cell phone, a tablet, a portable audio device (e.g. a MP3 player), a wireless system, a wireless speaker, an audio amplifier, a stereo, a car stereo, a wireless PA system etc. The synchronization scheme employed in the system 2 may be applied to any system or application that employs real-time modulated audio signals with varying or affecting clock sources. The synchronization scheme employed in the system 2 may be applied to any system or application having the output subsystem (e.g., H-bridge or related) where the change of a system state (i.e. oscillator frequency) is desired while the change of the system state may have an effect on the output subsystem performance (i.e. generating audio artifacts). The synchronization scheme employed in the system 2 may be applied to battery powered devices where a clock frequency change event is desired without any associated audio artifacts.

Any individual element or at least a part of the elements in the system 2 (e.g., the synchronization circuit 20) may be implemented in hardware as a digital circuit. Any individual element or at least a part of the elements in the system 2 may be implemented in hardware means through logic state machines and/or a programmable microcontroller or processor with an associated program storage element. Any individual element or at least a part of the elements in the system 2 may be implemented in hardware through firmware means for implementing the appropriate real-time control and the monitoring of the output signal. Any individual element or at least a part of the elements in the system 2 may be implemented as a separate chip or within a combined chip, which may include analog and digital components implemented in a CMOS semiconductor process. The synchronization scheme in the system 2 is digital based, and thus deterministic, and may be implemented by a processor with a memory storing one or more programs for implementing the synchronization of the trigger 22.

Figure 2:
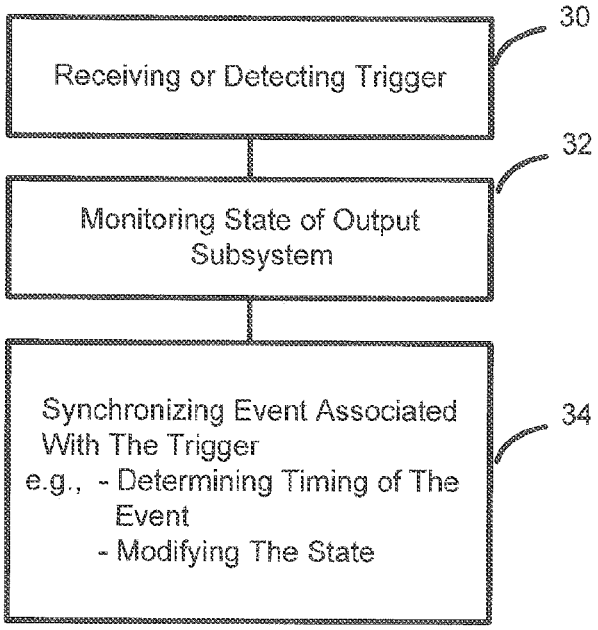
FIG. 2 is a flow diagram illustrating an example of a synchronization scheme that may be employed in the system of FIG. 1 in accordance with an embodiment of the present invention.

Referring to FIGS. 1 and 2, one exemplary operation of the synchronization circuit 20 is described. The synchronization circuit 20 receives or detects (30) the trigger 22. The synchronization circuit 20 monitors (32) the state of the output subsystem 8 to obtain the state information of the output subsystem 8. The synchronization circuit 20 synchronizes (34) the timing of the change of the clock frequency in response to the trigger 22, depending on the state information.

In FIG. 2, the receiving or detecting trigger step (30) is implemented before the monitoring step (32). However, these steps may be simultaneously implemented or the receiving or detecting trigger step (30) may be implemented after the monitoring step (32) is implemented. These steps may be repeatedly implemented before the synchronizing step (34). The receiving or detecting trigger step (30) may be continuously implemented before and after the synchronizing step (34).

The monitoring step (32) may include, for example, monitoring the driving scheme of the output subsystem 8 and/or the output sequence of the output subsystem 8. The synchronizing step (34) includes, for example, determining the timing of the clock frequency change event (e.g., changing or shifting the timing of the clock frequency change event or keeping the same timing) in view of the state of the output subsystem 8, modifying the state of the output subsystem 8, or a combination thereof. Here the timing of the actual clock frequency change event may be shifted from the original timing of the clock frequency change event. The modifying step includes, for example, generating, forcing or injecting a new state of the output subsystem 8 such that there is synchronization possible. The generating, forcing or injecting step may occur, for example, if the state information of the output subsystem 8 indicates there is no synchronization possible without inducing audio artifacts. The modifying step may include further changing the state of the output subsystem 8 to compensate for discrepancy in average energy to the output transducer 10.

The synchronization circuit 20 may wait a certain number of clock cycles before modifying the state of the output subsystem 8, and subsequently synchronize the timing of the clock frequency change event. The number of clock cycles that the synchronization circuit 20 will wait before modification is programmable. The synchronization circuit 20 may only modify the state of the output subsystem 8 after the programmable number of clock cycles is exceeded and during the programmable number of clock cycles the natural output of the output subsystem 8 does not contain a predetermined sequence which may be used to synchronize a clock frequency change event without inducing an artifact. This ensures that the frequency is modified within allowable limits based on the programmable number of cycles for the algorithm, and minimizes any potential artifact by only modifying the output state when it is necessary.

Through analog means the internal oscillator may be improved to reduce the high-to-low and low-to-high switching time. However, the analog means for improving the internal oscillator has the downside of possibly increased power consumption and increased system complexity. Further, the transition time is always non-zero, even if it is small. Therefore, even though the performance of the analog based system will be improved by reducing the period error, there will still be some error. This error will be worse on some devices versus others because of typical part-to-part differences in analog performance inherent with semiconductor processes. This means that the performance of the clock throttling event with respect to the audio artifact in the hearing aid may be improved through this analog means, but the audio artifact will always be present albeit less noticeable. By contrast, the change of the clock frequency in the system 2 of FIG. 1 is digital based and deterministic, resulting in reduction of variability of the apparent artifact since the performance is not dependent on the analog variability of the internal oscillator. Further, the design complexity can be decreased by eliminating harder requirements for the analog portions of the design, therefore the oscillator may result in longer and less determinant transients Referring to FIG. 3, there is illustrated an example of a DSP system to which the synchronization circuit 20 of FIG. 1 is applied. The DSP system 100 of FIG. 3 includes a memory storage unit 130 and a DSP 132, for generating audio signals through various hearing aid processing algorithms. The memory storage unit 130 stores audio data, which may be, for example, an audio FIFO. The audio data are read from the memory storage unit 130 based on instructions from the DSP 132 and provided to an output subsystem 108. The output subsystem 108 corresponds to the output subsystem 8 of FIG. 1. The output subsystem 108 includes a modulator 102 and an output driver 104. The modulator 102 includes, for example, a PWM or sigma-delta modulator for hearing aids. The modulator 102 takes the audio data and, through some modulation techniques, generates a modulated version of the signal. The modulator 102 output drives the output driver 104 by using a programmable driving scheme. The output driver 104 includes, for example, an H-Bridge circuit for creating a differential output signal (e.g., "+", "−" in FIG. 3). The output driver 104 provides a baseband audio signal to the output transducer 110. The output transducer 110 corresponds to the output transducer 10 of FIG. 1. In a non-limiting example, the output transducer 110 acts as a low-pass filter and, by demodulating the output driver 104 waveform, allows the baseband audio signal to be converted into sound energy 112.

The operation clock of the DSP system 100 is generated by a clock module 114. The clock module 114 corresponds to the clock module 14 of FIG. 1. The clock module 114 includes an oscillator 122 and a set of clock dividers 124. The oscillator 122 is to provide a stable and constant system clock to the clock dividers 124. The clock dividers 124 digitally divide the oscillator clock and subsequently provide a clock C1 to the DSP 132 and a modulator clock C2 to the modulator 102. The modulator clock is derived from the system clock (i.e., the oscillator clock). The clock dividers 124 are reconfigurable. The DSP clock C1 is synchronized with the system clock provided by the oscillator.

The DSP system 100 includes a clock throttling controller 120. The clock throttling controller 120 corresponds to the synchronization circuit 20 of FIG. 1. The clock throttling controller 120 is controlled primary from the DSP 132 through a clock switch signal 116 (e.g., trigger 22 of FIG. 1) to increase or decrease the system clock rate generated by the oscillator 122, which will eventually lead to a clock throttling event (hereinafter referred to as a "CTE"). The clock throttling controller 120 monitors the state of the modulator 102 output and controls the CTE. By considering the state of the modulator 102 output sequence in relation to change of the oscillator 122 frequency, the system 100 will reduce audio artifact or eliminate audio artifacts during the clock change event. The synchronization scheme may be employed to any devices with DSPs where high frequency operations are implemented for short periods.

Figure 3:
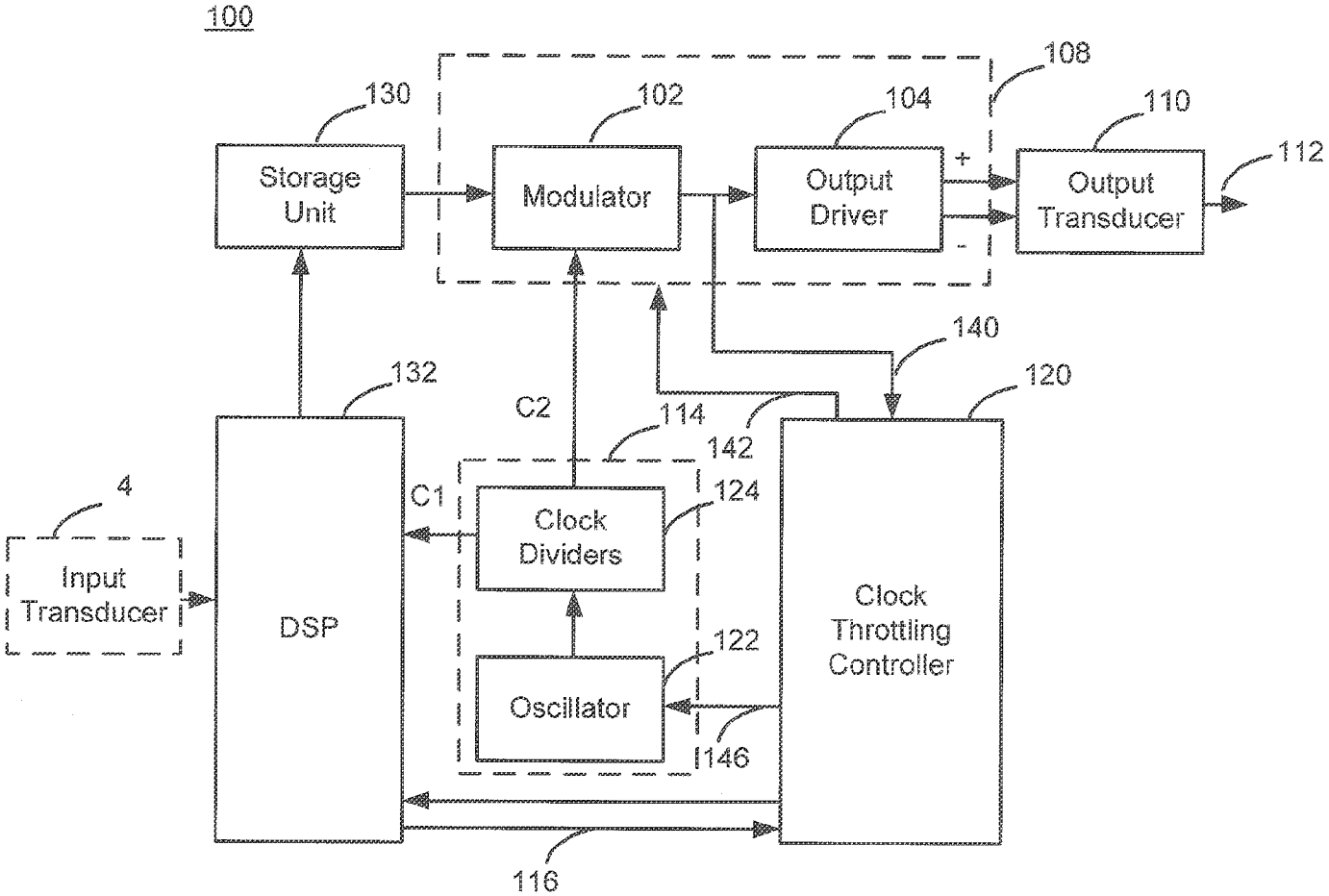
FIG. 3 is a block diagram illustrating an example of a DSP system employing the synchronization scheme in accordance with an embodiment of the present invention.

In FIG. 3, one modulator 102 and one oscillator 122 are illustrated for illustration purposes only. The number of each element in the system 2 may vary. The system 2 may include components not illustrated in FIG. 3. In a non-limiting example, the DSP system 100 includes more than one independent modulator 102 (i.e., a stereo output system or similar) where the output data streams of the modulator are independent. The clock throttling controller 120 may monitor the state of each modulator or all of the outputs of the modulators and either wait until they are all in a certain state or modify one or more modulators outputs. In a non-limiting example, the DSP system 100 includes multiple clocks where the clocks are independent. The DSP's clock may be switched from the multiple clocks, and the clock throttling controller 120 may control the clock frequency change event for each clock.

The modulator 102 and the output driver 104 are described in detail. In a non-limiting example, the modulator 102 operates in 2 state output mode, 3 state output mode or n state output mode (n>3), and the output driver 104 has 2 output states (+V, −V), 3 output states (+V, null, −V) or more than three output states, which are created by signals from the modulator 102. Here V may correspond to "1", and null may correspond to "0". The output state is effectively the difference as seen by an output transducer 110 of the output signals (e.g., "+", and "−" in FIG. 3). Hereinafter an output driver with 2 output states or 3 output states are referred to as 2-state or 3-state output drivers, respectively. In a non-limiting example, the output driver 104 may be a 2-state output driver, a 3-state output driver or a driver with any number of output states. In the 2-state output driver, the "+V" state provides charge to the output transducer where the "−V" state pulls charge from the output transducer. In the 3-state output driver, a null state (0 differential output) is present, and the "+V" and "−V" states provide or pull charge from the output transducer as per the 2-state output driver. In the null state no charge is provided or pulled from the output transducer. The null state is typically employed to reduce the overall power consumption since no current is drawn from the power supply during the null state.

Audio artifact is described in detail. When a CTE occurs, the oscillator 122 frequency changes either from a high-to-low frequency or low-to-high frequency. During this transition several clock pulses may be generated corresponding to intermediate frequencies. The period of these clock pulses may be inconsistent with the clock period of the other pulses before the CTE and after the CTE has completed and the oscillator frequency has stabilized (i.e., the CTE steady-state period). This period inconsistency results in a potential unbalance of the energy on the output of the output driver. Ideally the average output of the output driver is "0". For example, if there is no corresponding "−V" state for each "+V" state, the average output of the output driver is not substantially "0", resulting in that the amount of charge will grow endlessly. During a CTE the "+V" state may not provide the same amount of energy to the output transducer as that during the non-CTE event. If only a fraction of the unit energy is provided the average output of the output driver will no longer equal 0, resulting in a DC shift that creates audio artifacts. The magnitude of the audio artifact depends on the difference in a clock period during the CTE compared to the steady-state clock period (see FIGS. 4 and 6).

The clock throttling controller 120 is described further in detail. The clock throttling controller 120 synchronizes a clock frequency change event and compensate for the energy unbalance due to the clock change, to reduce or eliminate audio artifacts. When the DSP 132 provides the clock switch signal 116 to initiate a CTE, the clock throttling controller 120 switches into a state where it monitors (140) the state of the modulator 102 to determine under what conditions it may initiate the oscillator 122 frequency change without inducing noticeable artifacts on the transducer output. By considering the state of the modulator 102 output sequence in relation to the changing the oscillator 130 frequency, the system 100 will determine the actual timing of the CTE and initiate the CTE. After a transition period from the initiation of the CTE, the system clock frequency has been stabilized. The digital clock dividers 124 adjusts the modulator clock C2 to ensure that modulator clock C2 frequency is constant aside from the transition period.

In a non-limiting example, the clock throttling controller 120 initiates the CTE by changing the timing of the CTE via the control signal 146 synchronously to when the output state will be such that no audio artifact will be generated. In another non-limiting example, the clock throttling controller 120 modifies (142) the output of the modulator 102 to conduct the CTE as requested. In a further non-limiting example, the clock throttling controller 120 changes (146) the timing of the CTE and also modifies (142) the output of the modulator 102. In a further non-limiting example, the clock throttling controller 120 controls (142) the output driver 104 to force a new state. In a non-limiting example, the modifying the state of the modulator includes generating, forcing or injecting one or more subsequent modified states so that the CTE synchronization is possible without inducing audio artifacts and/or it compensates for any energy discrepancy which may have been generated.

In a non-limiting example, the clock throttling controller 120 waits for a null state in the output of the modulator 102 and initiates the CTE.

In a non-limiting example, the clock throttling controller 120 injects a null state at an appropriate time by replacing a +V or −V state with the null state, instead of waiting for a naturally occurred null state. If the +V or −V state is replaced with the null state, the average energy may be affected. Thus the clock throttling controller 120 may opt to compensate for the discrepancy in average energy as appropriate to restore the original mount of energy by forcing another null state (on the opposite state as the original forced null) or through some other means. This compensation operation may occur immediately before or after the initial forced null state or several periods before or after the null state, depending on when the natural opposite state occurs in the output stream.

In a non-limiting example, the clock throttling controller 120 forces the output of the modulator 102 to a null state and initiates the CTE. This means that the output waveform has lost the corresponding energy component (either "+V" or "−V"). The clock throttling controller 120 will remember which state was lost and subsequently replace a naturally occurring null state with the lost state if the natural null state occurs within a certain maximum distance (otherwise stated as a certain maximum number of cycles) from the forced null state. The certain maximum distance may be programmable. This forcing operation may be implemented for a 3-state mode, if the natural null state is not available when the CTE request is primary by the DSP.

Figure 4:
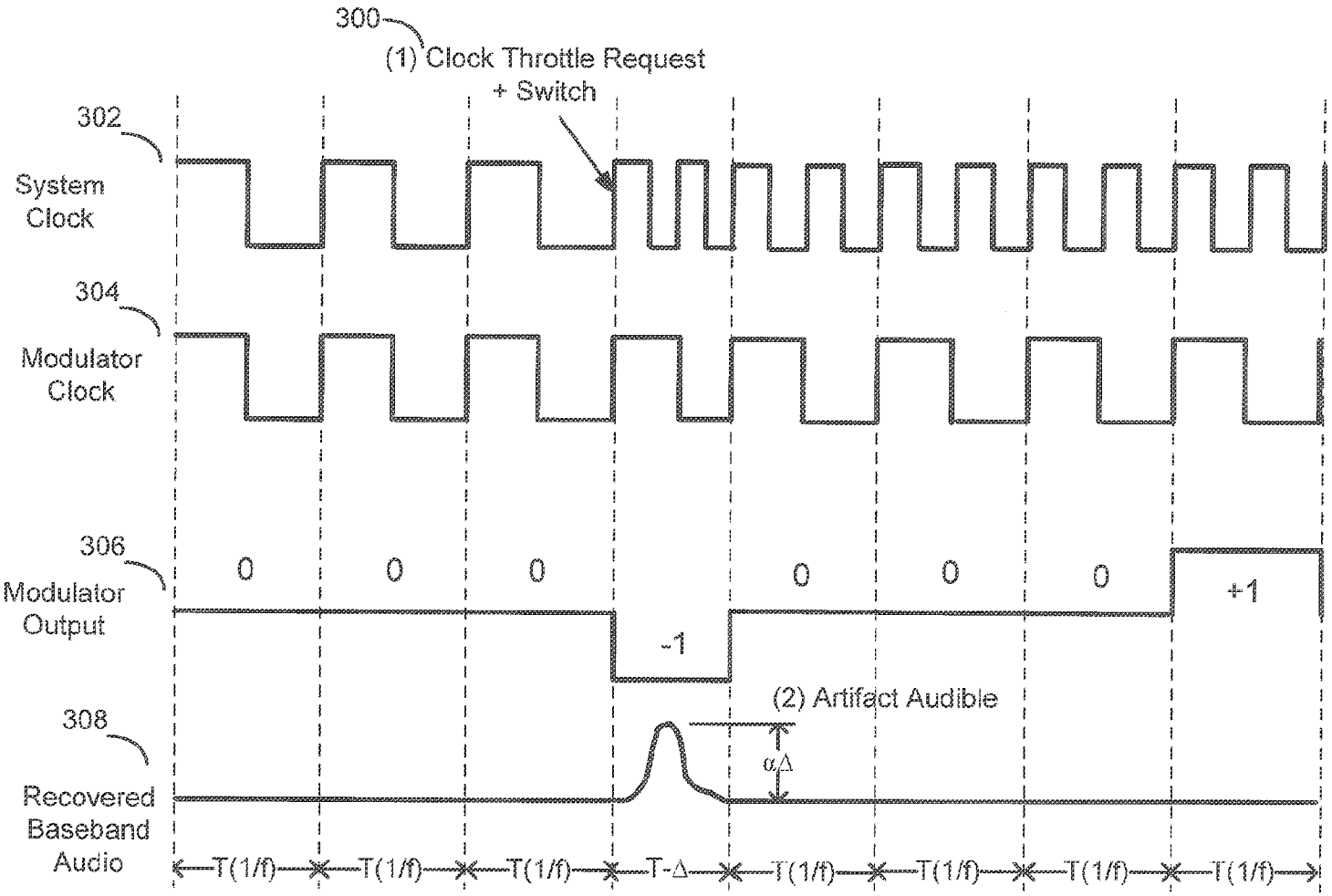
FIG. 4 is a diagram illustrating a 3-state operation where a clock switch causes a baseband audio artifact.

FIG. 4 illustrates waveforms of a 3-state operation without compensation by the clock throttling controller 120 of FIG. 3. In FIG. 4, "System Clock" represents a system clock 302 and corresponds to the oscillator clock, "Modulator Clock" represents an operational clock 304 provided to a modulator; "Modulator Output " represents a series of pulses 306 (+V, null, and −V) generated by the modulator for driving a 3-state output driver; "Recovered Baseband Audio" represents a baseband audio output 308 by the 3-state output driver; "T" represents an operation period of the system that is equal to 1/f ("f": frequency); "T-Δ" represents a clock transition time period; and "Δα" represents the magnitude of an artifact. The modulator output 306 has three states +V, null and −V ("+1", "0" and "−1" in FIG. 4) and drives the 3-state output driver.

The system clock's frequency and the modulator clock's frequency are initially "f". A CTE 300 occurs as primarily controlled by a clock switch from the DSP, and the system clock's frequency goes to 2f after the clock transition time period "T-Δ". Here the system clock 302 is subjected to a phase error during the first few cycle of the oscillator adjustment. During the clock transition time, the modulator clock 304 frequency is shorter than the steady-state clock period. During the clock transition time period "T-Δ", the modulator output 306 goes to −V state ("−1" in FIG. 4) which causes an energy unbalance. After the clock transition time period "T-Δ", the modulator clock 304 goes back to the steady-stay clock frequency "f".

Figure 5:
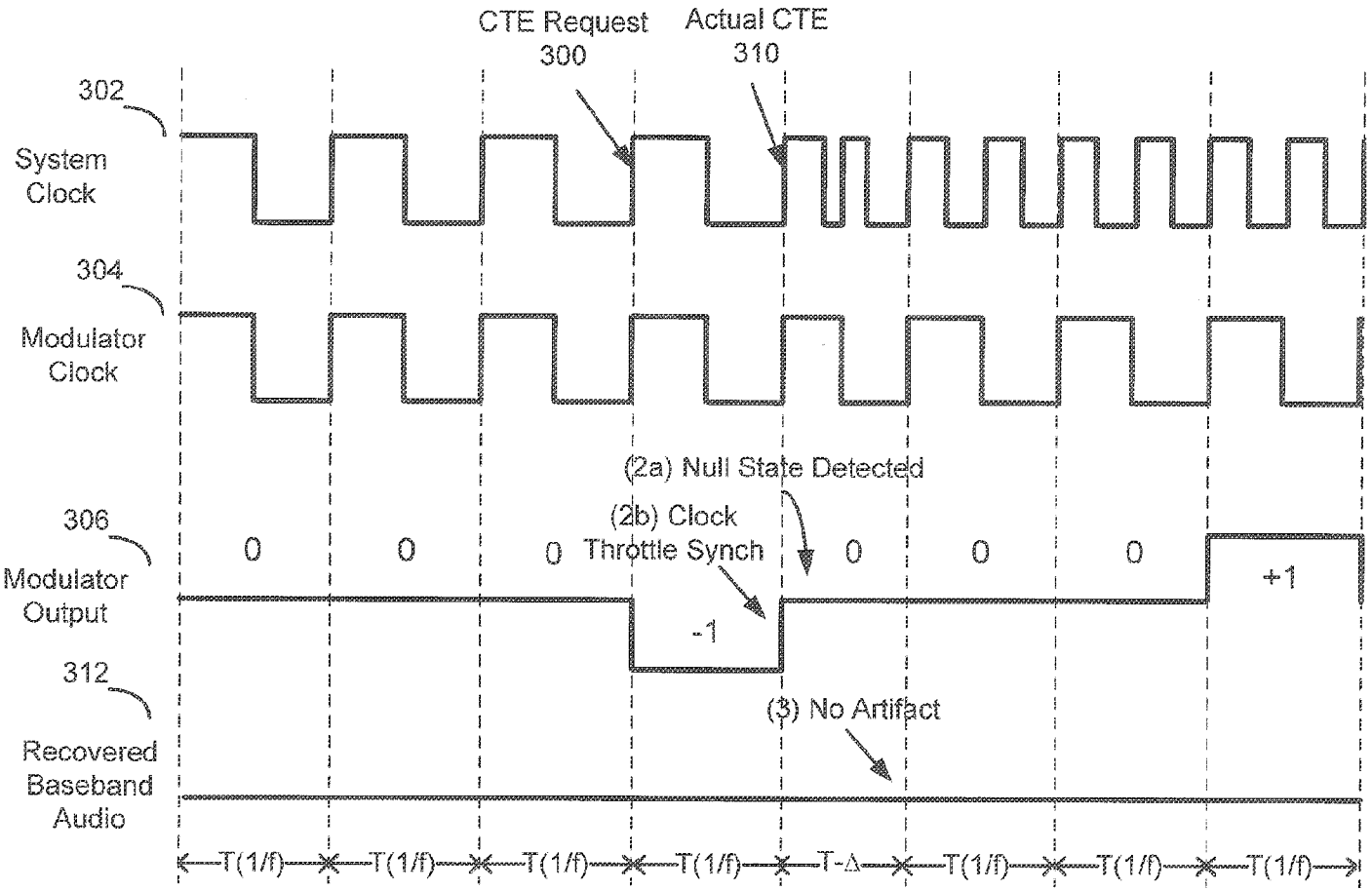
FIG. 5 is a diagram illustrating an example of a 3-state operation with the synchronization scheme, by delaying a clock frequency change event based on a modulator output in accordance with an embodiment of the present invention.

FIG. 5 illustrates one example of a 3-state operation with the clock throttling controller 120 of FIG. 3. In FIG. 5, "Recovered Baseband Audio" 312 shows how baseband audio from the output driver is changed by the clock throttling controller 120. The CTE 300 is initiated at the same timing of FIG. 4. However, in FIG. 5, the actual timing of the CTE is changed (310).

Referring to FIGS. 3 and 5, the output driver 104 is a 3-state output driver driven by 3 states containing a natural null state ("0"). Here the clock throttling controller 120 utilizes the natural null state by which no current is provided or pulled from the transducer. The CTE 300 request is initiated by the DSP 132. The actual CTE 310 then occurs when the modulator output 306 turns to be "0" such that the modulator output 306 is "0" during the transition period ("T-Δ") of the system clock 302. Here the clock throttling controller 120 synchronizes the CTE with the anticipated null state, resulting in no discrepancy or no unbalance in the average energy available to the transducer. Synchronizing the CTE to the null state results in no discrepancy in the average energy available to the output transducer and thus no or less artifact is generated.

Figure 6:
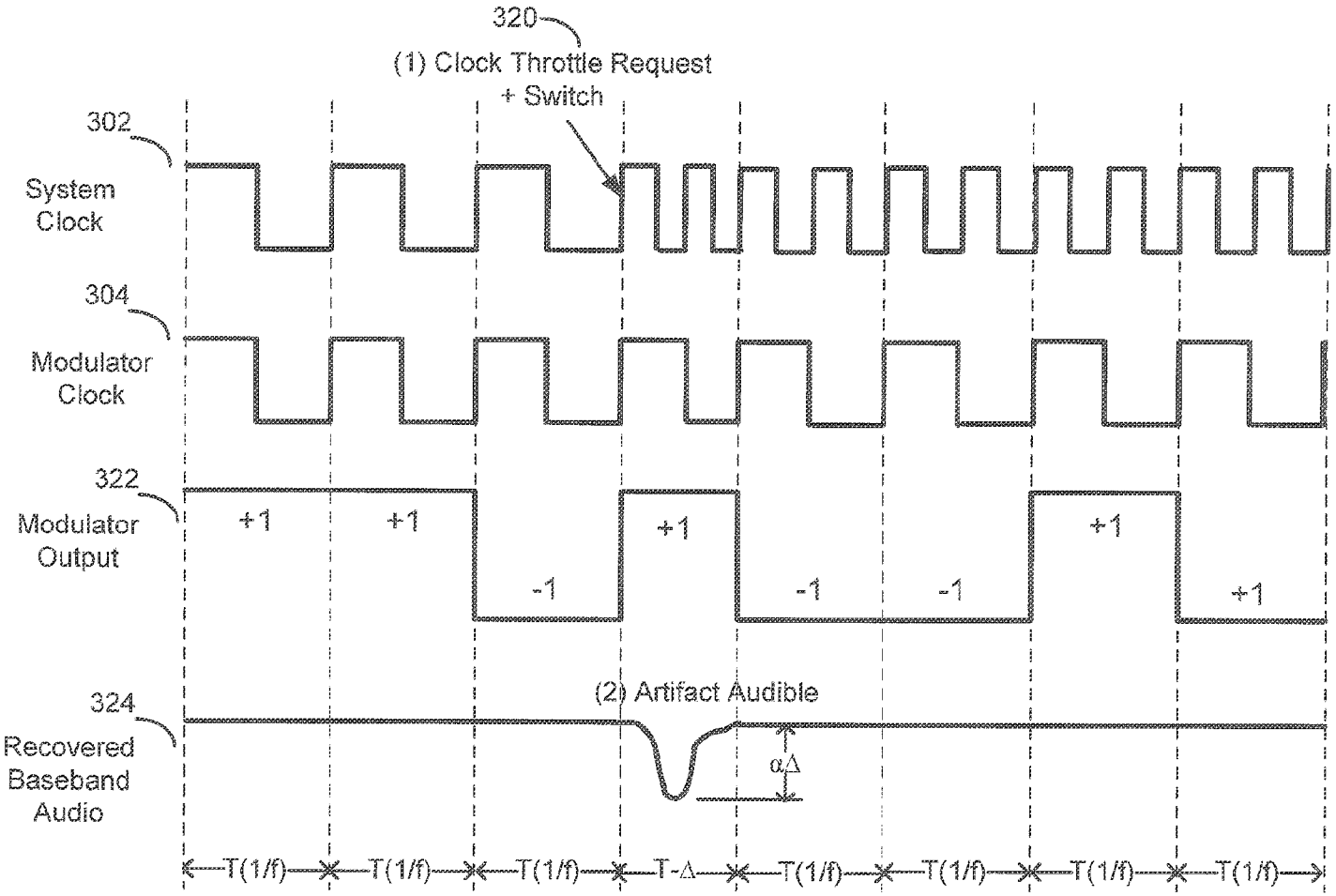
FIG. 6 is a waveform diagram illustrating a 2-state operation where a clock switch causes a baseband audio artifact.

FIG. 6 illustrates waveforms of a 2-state operation without compensation by the clock throttling controller 120 of FIG. 3. In FIG. 6, "Modulator Output" represents a series of pulses 322 which has two states +V and −V ("+1" and "−1" in FIG. 6) to drive a 2-state output driver; and "Recovered Baseband Audio" represents baseband audio output 324 by the output driver. The system clock's frequency and the modulator clock's frequency are initially "f". A CTE 320 occurs as controlled by a clock switch from the DSP, and the system clock's frequency goes to 2f after the clock transition time period "T-Δ". The system clock 302 is subjected to a phase error during the first few cycles of the oscillator adjustment. During the clock transition time period "T-Δ" (<T), the modulator output 322 goes to +V state ("+1" in FIG. 6) which causes an energy unbalance.

Figure 7:
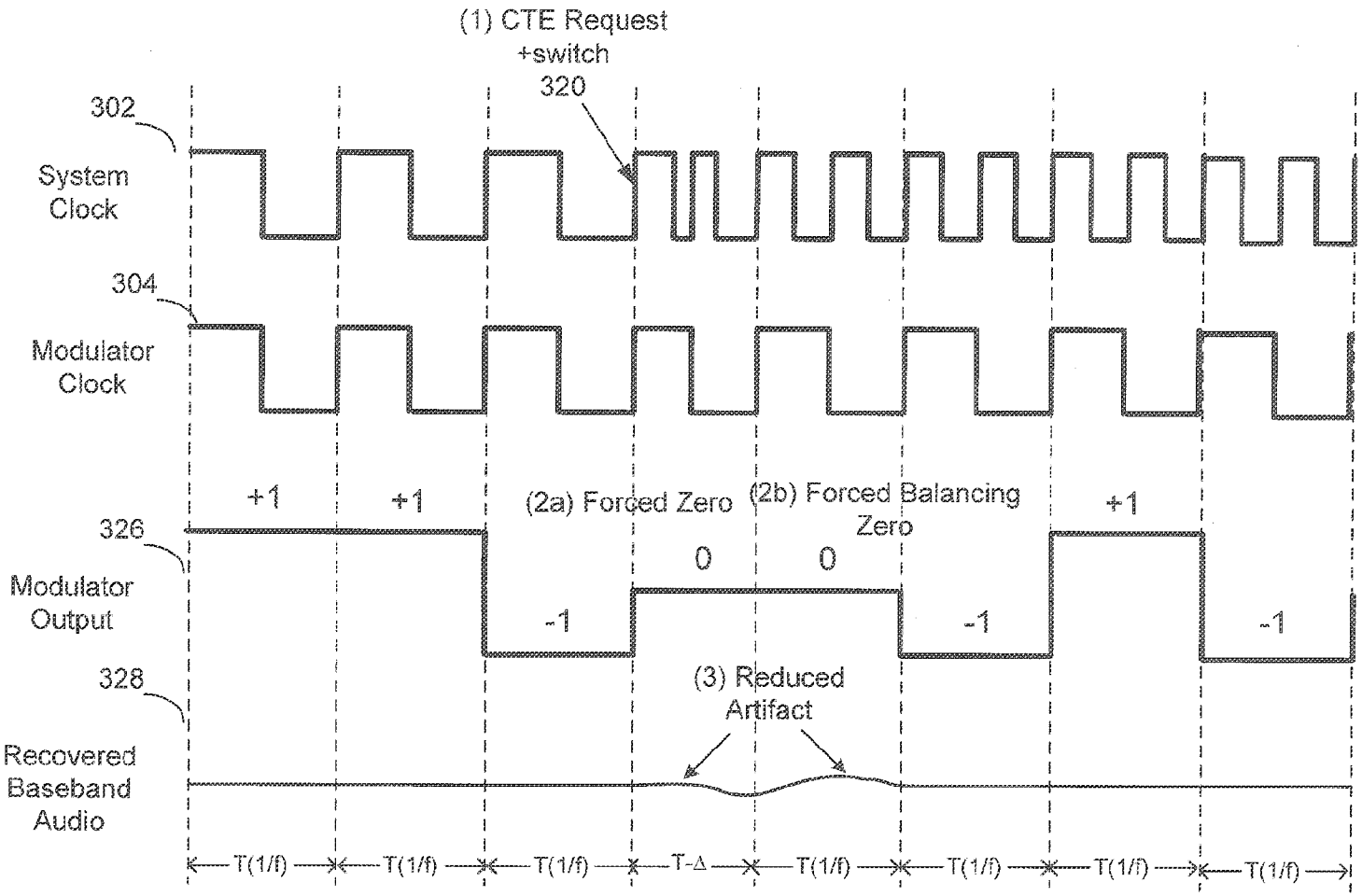
FIG. 7 is a diagram illustrating an example of a 2-state operation with the synchronization scheme, by forcing the modulator output to a null state in accordance with an embodiment of the present invention.

FIG. 7 illustrates one example of a 2-state operation with the clock throttling controller 120 of FIG. 3. In FIG. 7, "Modulator Output" 326 shows how the modulator output is changed by the clock throttling controller 120; and "Recovered Baseband Audio" 328 shows how baseband audio output from the output driver is changed by the clock throttling controller 120. The CTE 320 occurs at the same timing of FIG. 6. However the modulator output 326 is different from the modulator output 322 of FIG. 6. The modulator output 326 has three states +V, −V and null ("+1", "−1" and "0" in FIG. 7).

Referring to FIGS. 3 and 7, the output driver 104 is a 2-state output driver where a natural null state ("0") does not occur in a normal operation. Here the clock throttling controller 120 modifies the output of the modulator 102 by creating a 3-state output for a short period of time by forcing the output "+1" and "−1" to "0" for two cycles. In FIG. 7, if left unmodified, the output states would have been "+1" and "−1", which results in a net 0 amount of energy applied to the output transducer 110. The modified output 326 also results in a net 0 amount of energy applied to the output transducer 110 by changing the "+1" and "−1" states. In this configuration an audio artifact may be generated due to the loss of the baseband audio information during those two output states and not from an energy unbalance. However, the audio artifact in this situation is less than the artifact caused by the unbalance and hence there is an overall improvement in performance.

In the above examples, the output of the modulator 102 of FIG. 3 is modified to initiate a CTE. However, the state of the output driver 104 may be modified to initiate the CTE. In a non-limiting example, the clock throttling controller 120 generates a null state in the output driver 104 to initiate the CTE.

Figure 8:
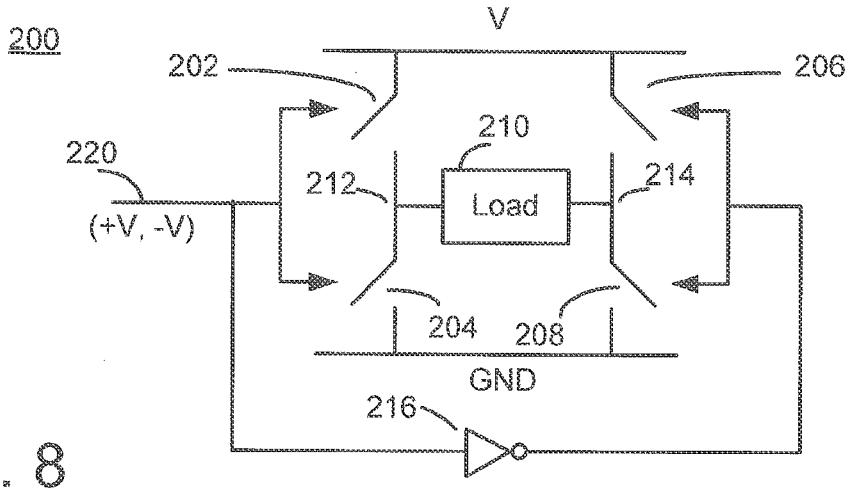
FIG. 8 is a schematic diagram illustrating a class D power converter.

For example, the output driver 104 of FIG. 3 is a multiple-state output driver operating without a null state in a normal operation, however, will be in the null state by the clock throttling controller 120. One example of multiple-state output drivers operating without a null state is a class D power converter 200 shown in FIG. 8. The power converter 200 includes switches 202, 204, 206 and 208 coupled in a bridge configuration. The switches 202 and 204 are coupled in series between V and Ground lines. The switches 206 and 208 are coupled in series between the V and Ground lines. The switches 202 and 204 are operated by a control signal 220. The switches 206 and 208 are operated by the signal 220 via an inverter 216. A load 210 is connected to an output node 212 coupling to the switches 202 and 204 and an output node 214 coupling to the switches 206 and 208. During the 2-state mode operation of the power converter 200, the converter 200 outputs a potential difference of either +V or −V across the load 210 at any given time where V is the voltage reference of the converter's output stage. Here +V may correspond to "1" and −V may correspond to "−1".

Figure 9:
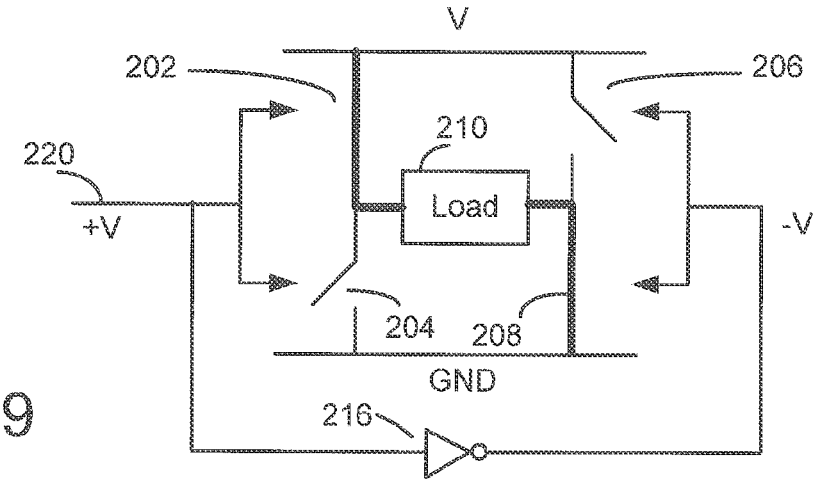
FIG. 9 is a schematic diagram illustrating one state of the power converter shown in FIG. 8.
Figure 10:
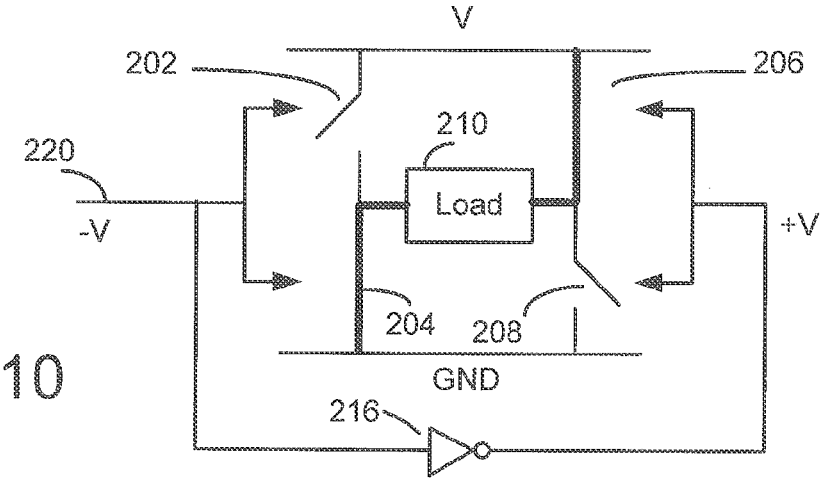
FIG. 10 is a schematic diagram illustrating another state of the power converter shown in FIG. 8.

The signal 220 from a modulator (e.g., a sigma-delta or PWM type modulator) will open/close the switches on two halves of the H-bridge as shown in FIGS. 9 and 10. Each half of the bridge produced an output of either +V or 0V. The difference produced across the H-bridge represents a modulated baseband signal. In the 2-state mode, the switches 202, 204, 206, and 208 are controlled such that the left and right halves of the H-bridge are always complements of each other.

Figure 11:
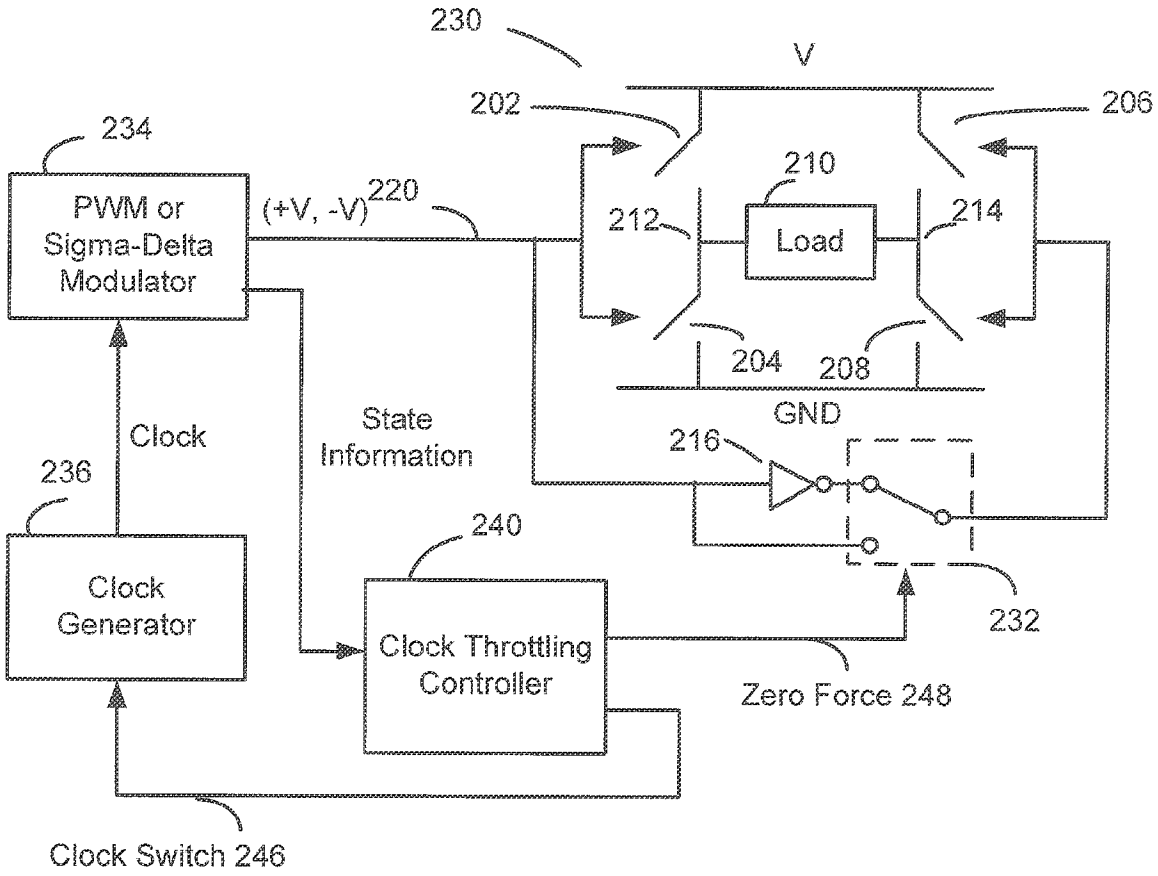
FIG. 11 is a schematic diagram illustrating an example of a system having the power converter shown in FIG. 8 with the synchronization scheme in accordance with an embodiment of the present invention.
Figure 12:
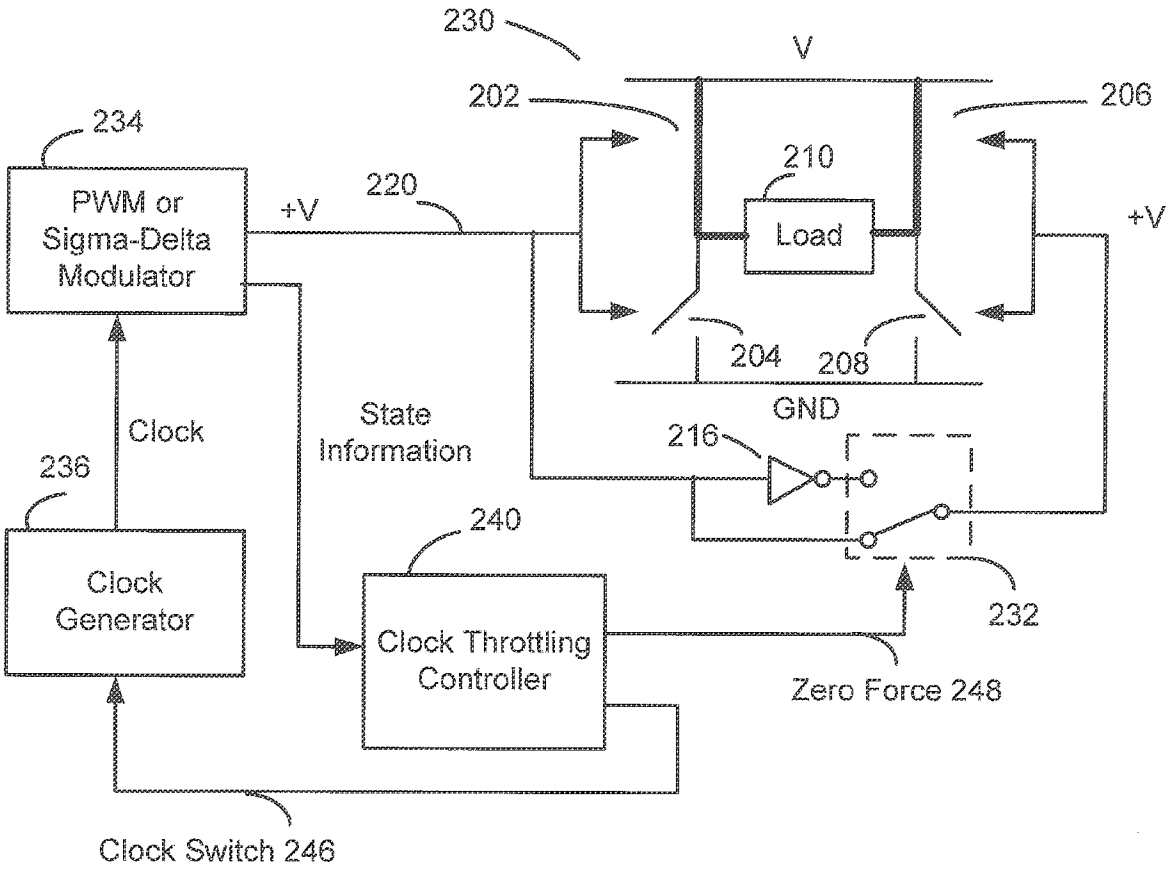
FIG. 12 is a schematic diagram illustrating a forced zero state of the system shown in FIG. 11 in accordance with an embodiment of the present invention.

In a non-limiting example, the output driver 104 of FIG. 3 includes the 2-state power converter 200, and implements a 3-state operation by using a switch 232, as shown in FIGS. 11 and 12.

Referring to FIGS. 11 and 12, an output driver 230 includes the power converter 220 and the switch 232. The switches 206 and 208 is operated by the signal 220 via the inverter 216 and the switch 232. The signal 220 is generated by a modulator 234. A clock generator 236 provides a clock to the modulator 234. A clock throttling controller 240 monitors the state of the modulator 234, and provides, to the clock generator 236, a clock switch 246 for changing the frequency of the clock, based on a trigger (e.g., 22 of FIG. 1, 116 of FIG. 3). The clock throttling controller 240 operates the switch 232 by a zero force signal 248, depending on the state of the modulator 234. The output driver 230, the modulator 234, the clock generator 236, and the clock throttling controller 240 correspond to the output driver 104, the modulator 102, the clock module 114, and the clock throttling controller 120 of FIG. 3. The modulator 234 is, for example, a PWM or a sigma-delta modulator.

The switch 232 selectively provides either the output of the inverter 216 or the signal 220 to the switches 206 and 208. The clock throttling controller 120 forces a zero state through both complementary "+V" and "−V" states by operating the switch 232. When the switches 206 and 208 are operated via the inverter 216, the output convertor 200 operates as a 2-state driver, as shown in FIGS. 9 and 10. When the zero force signal 248 operates on the switch 232, the signal 220 is provided to the switches 206 and 208, by bypassing the inverter 216. Here, the "+V" (or "−V") state of the signal 220 is forced to a zero state such that the switches 202 and 206 (or switches 204 and 208) are on.

Referring to FIGS. 7, 11 and 12, one example of a 2-state operation with the clock throttling controller 240 is described in detail. A CTE occurs at the same timing of FIG. 6. The CTE occurs as primarily requested. However "Modulator Output" has three states +V, −V and null ("+1", "−1" and "0" in FIG. 7). Here "Modulator Output" represents the state of the output driver. If not modified, the output of the output driver 230 is either +V or −V.

The clock throttling controller 240 monitors state information from the modulator 234 to determine when the appropriate "+V" and/or "−V" state will be occurred by the modulator 234. The "0" state(s) is forced in the output driver 230 by operating the switch 232. The "+V" and "−V" states are forced to zero states. By replacing a +V and −V states with a zero potential state during the CTE, the summed potential across the H bridge will not become unbalanced due to any clock error. By forcing two zero potential states, some distortion may be added, however, the net effect will be less than that of the unbalanced situation due to the clock error. This distortion will also be deterministic, and will remain constant regardless of the amount of the clock phase error.

In FIGS. 11 and 12, the 2-state output driver 200 having four switches is shown as a component of the output driver 230, for illustration purposes only. It would be appreciated by one of ordinary skill in the art that the configuration of the output driver 230 is not limited to that of FIGS. 11 and 12 and may vary.

Figure 13:
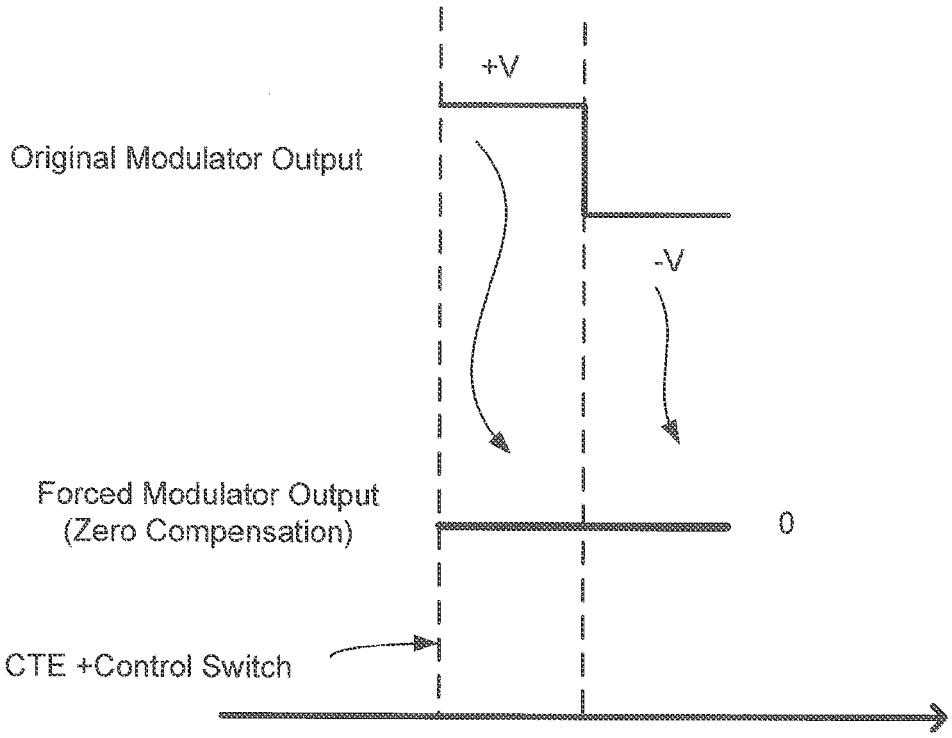
FIG. 13 is a schematic diagram illustrating an example of an enhancement technique for minimizing the amount of distortion in accordance with an embodiment of the present invention.

In a non-limiting example, an enhancement technique may be employed to force the output of the modulator (or input to the output driver) to zero (null) when a +V/−V or −V/+V state transition occurs, as schematically illustrated in FIG. 13. A CTE original request can occur at anytime. The CTE event however is delayed until the +V/−V or +V/−V state transition occurs in the output stream of the modulator. The enhancement technique may be employed with the synchronization technique described above. This enhancement technique will minimize the amount of distortion of the resultant audio signal as described below.

In a non-limiting example, the enhancement technique ("first enhancement (mode)") is employed such that the clock throttling controller forces two zeros and synchronizes the CTE to a point in time where two adjacent +V and −V events occur back-to-back. The two forced zero potential states will occur back-to-back with each other, allowing a reduction in time which the output is unbalanced and hence reducing the distortion.

In a further non-limiting example, the enhancement technique ("second enhancement (mode)") is employed such that only a "single" zero is forced. For the zero forcing, the system detects −V and −V which are adjacent to each other as it is done in the first enhancement mode. In the second enhancement mode, the zero forcing only happens for one clock cycle which 'straddles' the +1/−1 or −1/+1 (or +V/−V or −V/+V) transition point. This clock cycle may have one or less than one normal period of the system clock or the modulator clock. This is useful for systems where the phase error of the clock will only be present for a single clock period. By employing this second enhancement technique, the amount of distortion can be further reduced because the unbalanced time will be reduced from two periods to one period. To force a single zero, the system employs an out-of-phase clock method where two clocks are used: one being in phase with the system clock (or the oscillator clock itself), and the other being 180 degrees out of phase from the system clock (the out-of-phase clock). The out-of-phase clock may be generated via an inverter coupling to the system clock In a normal operation mode, the modulator may operate based on the original modulator clock in phase with the system clock or the out-of-phase clock. In the second enhancement mode, the system slices each of +V and −V which are adjacent to each other, so that the output driver or converter outputs a zero only during a period where the system clock phase is not stable. This may be done by slicing the adjacent +V and −V blocks in half. The handling of the clocking can be completely managed by the clock throttling controller, and the modulator will not be required to have knowledge of different clocks. The modulator can run off the out of phase clock at all times, and the clock throttling controller will control the zero forcing, according to the appropriate clock edges.

Figure 14:
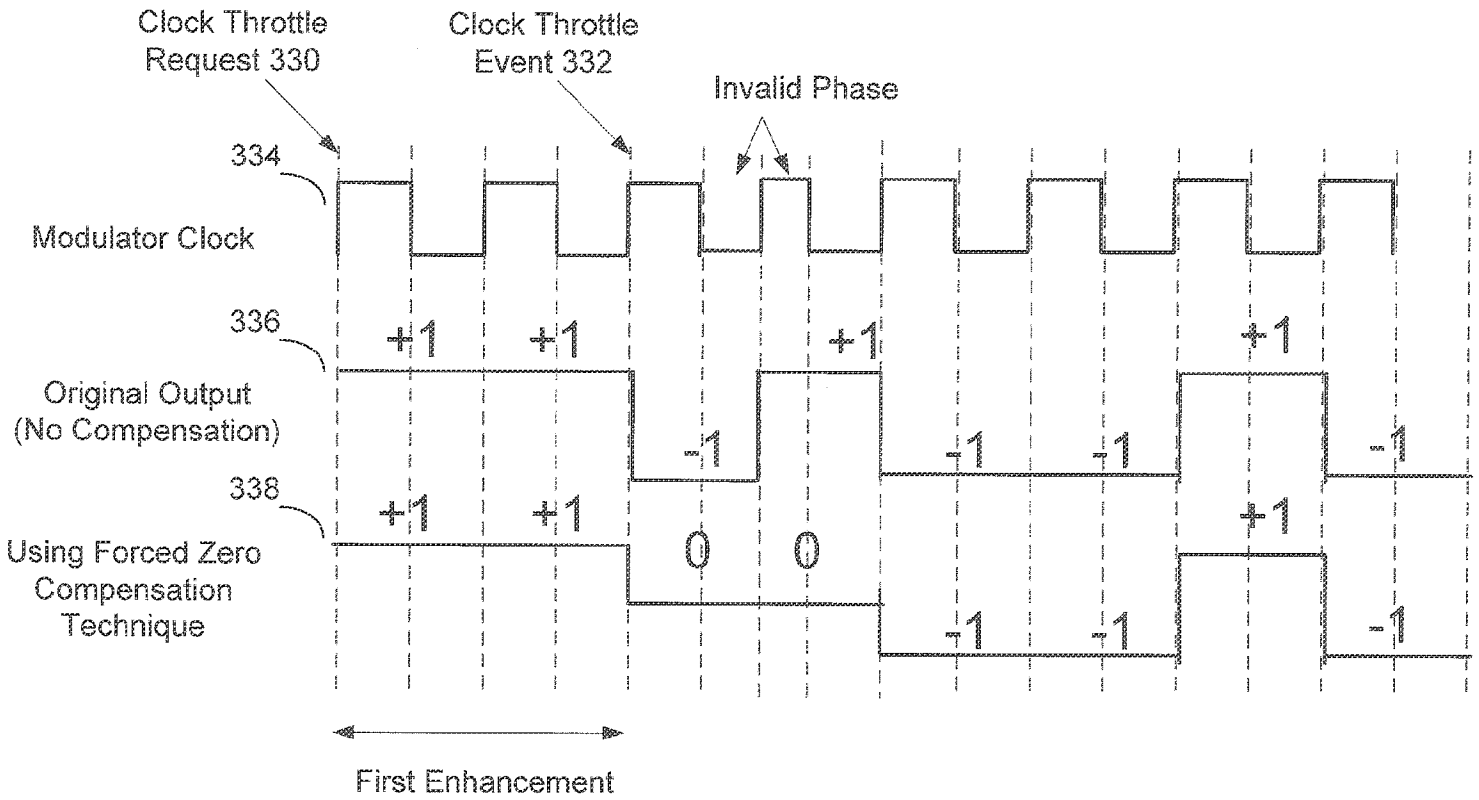
FIG. 14 is a schematic diagram illustrating an example of the enhancement technique shown in FIG. 13.

Referring to FIG. 14, one example of the first enhancement technique is described. In FIG. 14, "Modulator Clock" represents a clock 334 going to a modulator (e.g., 102 of FIG. 3, 234 of FIGS. 11-12); "Original Output" represents a series of pulses 336 generated by the modulator and provided to an output driver when no enhancement is implemented; and "Using Forced Zero Compensation Technique" represents a series of pulses 338 which is an output state from the modulator or an input state provided to the output driver when the first enhancement is implemented. The output state 338 shows how zero forcing by the first enhancement changes the modulator output 306.

In this example, the modulator operates in 2-state mode ("V", "−V"). When an original CTE 330 request is received, the clock throttling controller waits until a −1/+1 transition so that it can force them to 0 with the minimum spacing between the two pulses (i.e., no space). Therefore the output state 338 has +V, null and −V states. The actual CTE 332 occurs at a timing different from that of the CTE 330. The CTE is delayed (332) until the −1/+1 transition.

The first enhancement simply ensures that a delay of CTE is implemented so that the actual CTE 332 only occurs when a −1/+1 (or +1/−1) transition is back-to-back, instead of potentially spread by several other states.

Figure 15:
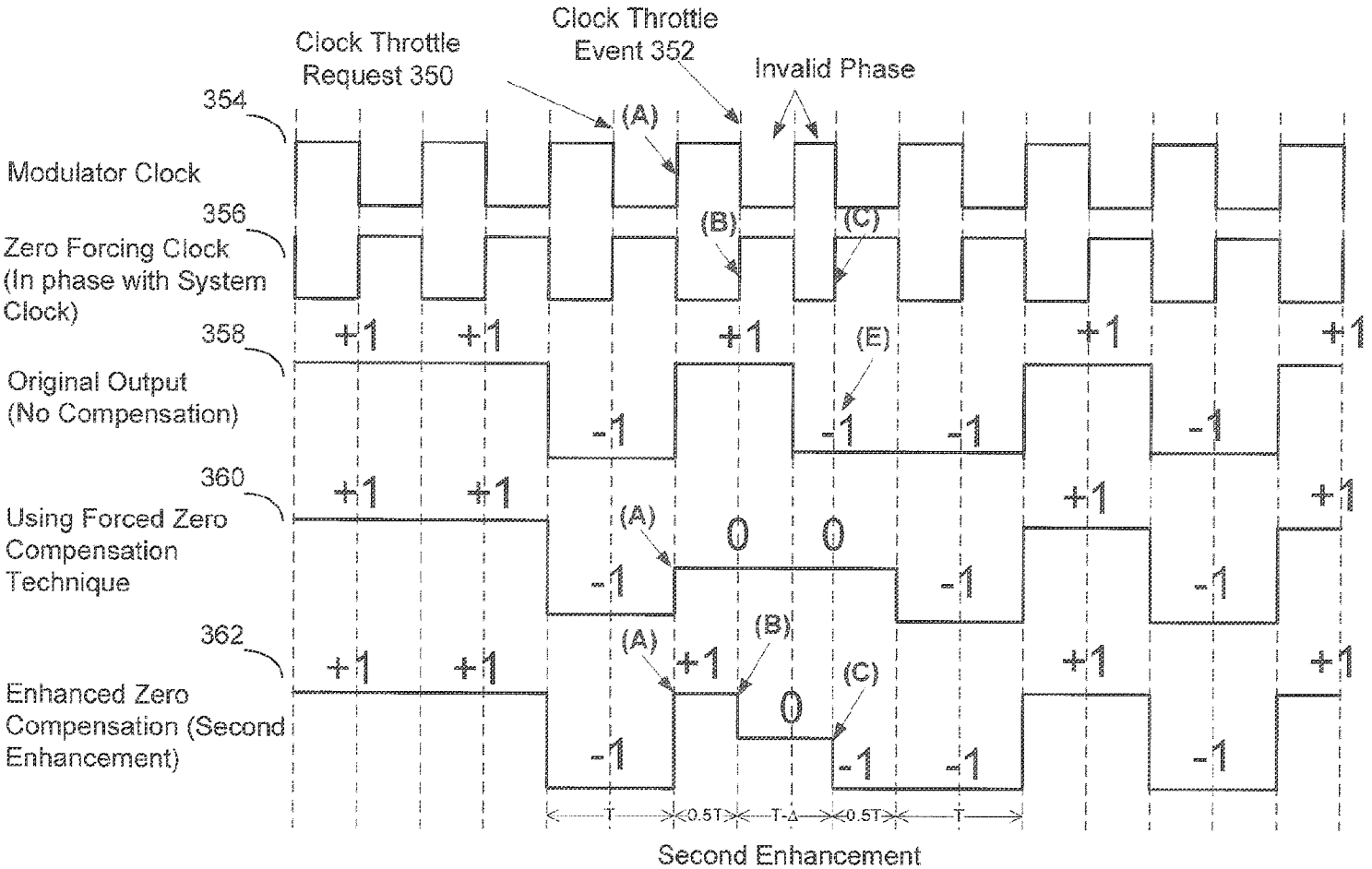
FIG. 15 is a diagram illustrating a further example of the enhancement technique shown in FIG. 13.

Referring to FIG. 15, one example of the second enhancement technique is described. In FIG. 15, "Modulator Clock" represents a clock 354 going to a modulator (e.g., 102 of FIG. 3, 234 of FIGS. 11-12); "Zero Forcing Clock" represents a clock 356 in phase with the system clock (e.g., the oscillator clock from the oscillator 122 of FIG. 3) and out-of-phase from the modulator clock 354; "Original Output" represents a series of pulses 358 generated by the modulator and provided to an output driver when no enhancement is implemented; "Using Forced Zero Compensation Technique" represents a series of pulses 360 which is an output state from the modulator or an input state provided to the output driver when the first enhancement is implemented; and "Enhanced Zero Compensation" represents a series of pulses 362 which is an output state from the modulator or an input state provided to the output driver when the second enhancement is implemented. The nominal period of each of the modulator clock 354 and the zero forcing clock 356 is "T". "T-Δ" represents a clock transition time period which indicates the period has shifted because of the oscillator change.

In this example, the modulator operates in 2-state mode ("V", "−V") and is clocked off the 180 degree out of phase clock. When an original CTE 350 request is received, the clock throttling controller in the first or second enhancement mode waits until a −1/+1 transition to force zeros and initiate an actual CTE 352. The actual CTE 352 occurs at a timing different from that of the CTE 350. The output state 362 is forced to 0 for an unknown time while the clock is settled. This unknown time (phase transition period) is minimized in the second enhancement mode compared to that of the first enhancement mode, by using the clock 356 with respect to the clock 354, and thus results in a minimized artifact, as described below.

When the system operates in a normal mode, the original modulator output 358 goes −1 to +1 at position (A) of FIG. 15, and returns to −1. If the actual CTE 352 occurs at position (B) of FIG. 15 before the modulator output 358 returning to −1, that −1 state would be too short in time as shown in (E) of FIG. 15 because of the oscillator change. The period inconsistency between "+1" and "−1" results in a potential unbalance of the energy on the output of the output driver.

When the system operates in the first enhancement mode, the clock throttling controller waits until a +1/−1 transition at position (A), and subsequently zeros two full clock pulses (see "Using Forced Zero Compensation Technique" 360). This zero forcing creates a net zero energy which is the same as the original signal.

When the system operates in the second enhancement mode, the clock throttling controller delays the zero forcing. The output state 362 shows that the zero forcing is delayed by half a clock pulse from position (A) to position (B), for "0.5T", and then occurs for one cycle between position (B) and position (C), for "T-Δ". After the zero forcing, the output state 362 is the same as the original modulator output 358. In the second enhancement mode, the forced zero portion between (B) and (C) is straddled between the original +1 and −1 pulses, for T-Δ which is less than one normal period T. The "+1" pulse at (A) is only output for half a cycle, and the "−1" pulse at (C) is only output for half a cycle.

The CTE 350 request can occur at anytime; however, this CTE 350 request is delayed 352 until the +1/−1 occurs in the output stream; subsequently, using the clock 356, the output state 362 is forced to zero during the oscillator transition "T-Δ". The clock 356 allows the zero forcing to occur "halfway" through the +1 output state from (B). Here the zero forcing is minimized as 0.5*(+1)+0.5*(−1)=0. Further, the force occurs synchronous with the CTE, and therefore no or less artifact is created.

The out-of-phase clock method is utilized for the enhanced zero compensation 362 (the second enhancement). The zero forcing by the out-of-phase clock method is not limited to one shown in FIG. 15. There may be other ways to implement it.

Figure 16:
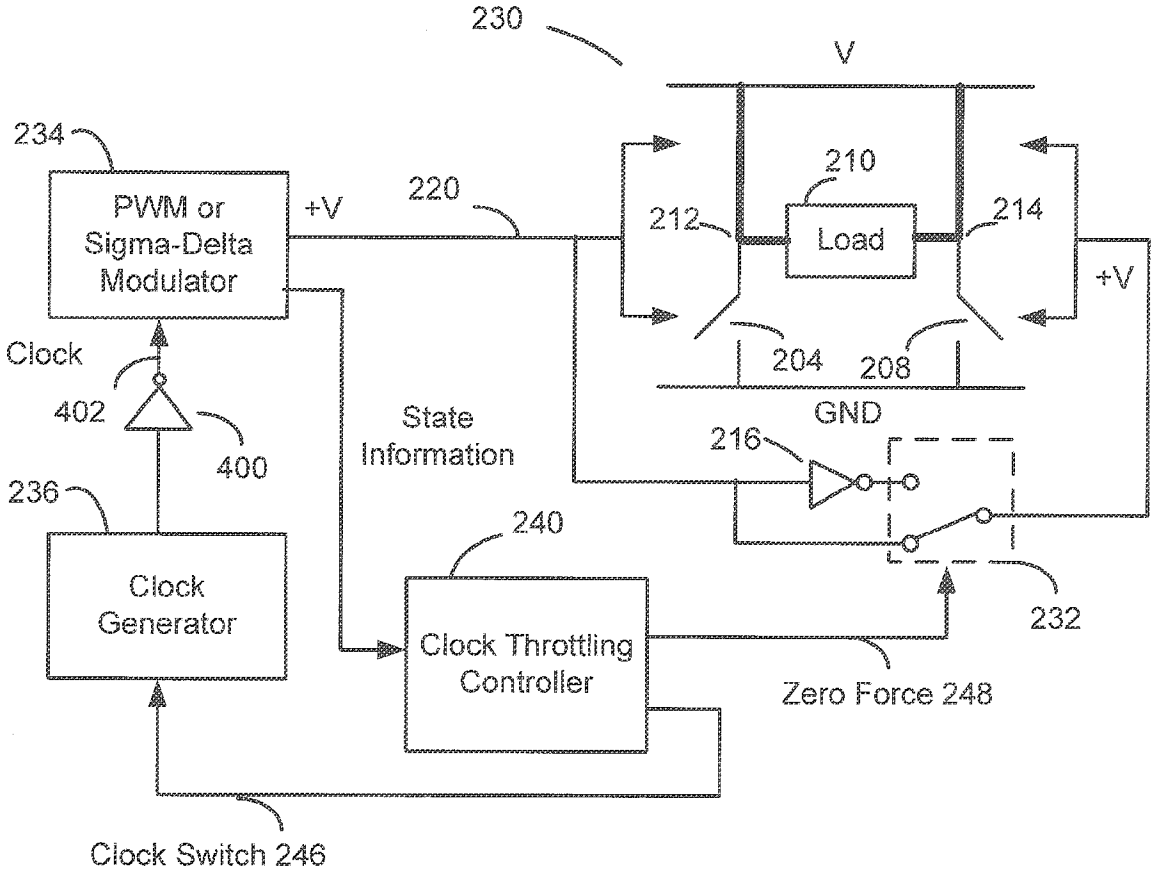
FIG. 16 is a schematic diagram illustrating an example of a system that may implement the enhancement technique shown in FIGS. 13-15, in accordance with an embodiment of the present invention.

Referring to FIG. 16, there is illustrated an example of a system to which the second enhancement technique shown in FIG. 15 is employed. The system of FIG. 16 includes the same elements of FIGS. 11-12, and further includes an inverter 400 which creates a 180 degrees out of phase clock signal 402 (e.g., 354 of FIG. 15). The clock 402 corresponds to the clock 354 of FIG. 15, and a clock corresponding to the clock 356 of FIG. 15 is provided to the clock throttling controller 240.

Figure 17:
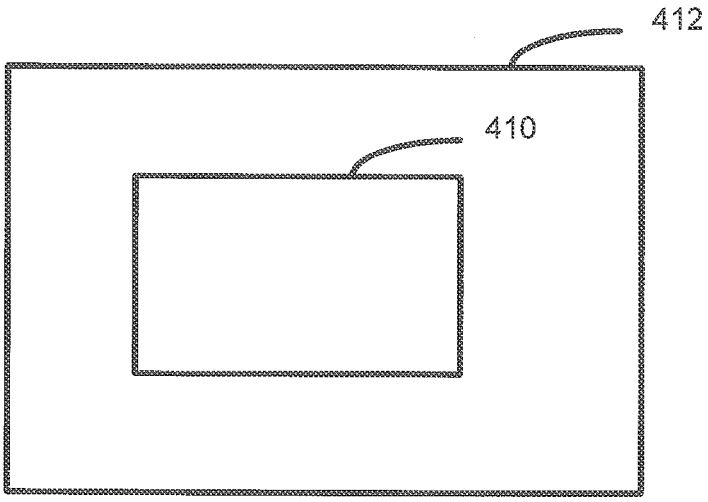
FIG. 17 is a schematic diagram illustrating an enlarged plan view of a portion of an embodiment of a semiconductor device or integrated circuit in accordance with an embodiment of the present invention.

FIG. 17 illustrates an enlarged plan view of a portion of an embodiment of a semiconductor device or integrated circuit 410 (hereinafter referred to as "circuit 410") formed on a semiconductor substrate 412. In FIG. 17, one circuit 410 is illustrated, however, more than one circuit may be found on the semiconductor substrate 412. The circuit 410 is formed on the substrate 412 by semiconductor manufacturing techniques that are well known in the art. In one embodiment, the circuit 410 includes one or more than one element of the listening system of FIG. 1 (e.g., the synchronization circuit 20 of FIG. 1). In another embodiment, the circuit 410 includes one or more than one element of the DSP system 100 of FIG. 3 (e.g., the clock throttling controller 120 of FIG. 3). In a further embodiment, the circuit 410 includes one or more than one element of the system of FIG. 11, 12 or 16 (e.g., the clock throttling controller 240 of FIG. 11, 12 or 16).

Each element in the embodiments of the present disclosure may be implemented as hardware, software/program in a carrier, or any combination thereof. Software codes, either in its entirety or a part thereof, may be stored in a computer readable medium or a physical memory (e.g., as a ROM, for example a CD ROM or a semiconductor ROM, or a magnetic recording medium, for example a floppy disc or hard disk). The program may be in the form of source code, object code, a code intermediate source and object code such as partially compiled form, or in any other form. A computer data signal representing the software code which may be embedded in a carrier wave may be transmitted via a communication network. The carrier may be any entity or device capable of carrying the program. Further the carrier may be a transmissible carrier such as an electrical or optical signal, which may be conveyed via electrical or optical cable or by radio or other means. When the program is embodied in such a signal, the carrier may be constituted by such cable or other device or means. Alternatively, the carrier may be an integrated circuit in which the program is embedded, the integrated circuit being adapted for performing, or for use in the performance of, the relevant method.

In view of all of the above, it is evident that a novel system and method is disclosed. Included, among other features, is synchronizing the timing of the change of a clock frequency based on the state of an output subsystem, resulting in reduction or elimination of audio artifact from an output transducer.

While the subject matter of the invention is described with the embodiments, the foregoing drawings and descriptions thereof depict only typical embodiments of the subject matter and are not therefore to considered to be limiting of its scope. It is evident that may alternatives and variants will be apparent to those skilled in the art.

As the claims hereinafter reflect, inventive aspects may lie in less than all features of a single foregoing disclosed embodiment. Thus, the hereinafter expressed claims are hereby expressly incorporated into this Detailed Description, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

What is claimed is:

1. A method of improving quality of an audio circuit, the method comprising:

configuring the audio circuit to monitor the state of an output subsystem for driving an output transducer based on a system clock, the output transducer for outputting audio sound;

configuring the audio circuit to monitor an event affecting the frequency of the system clock; and configuring the audio circuit to, in response to the event, synchronize the timing of the change of the clock frequency based on the state of the output subsystem to reduce or eliminate audio artifacts including configuring the audio circuit to initiate the change of the clock frequency in response to the state of the output subsystem, and in response to the state of the output subsystem indicating possible audio artifacts, modify the state of the output subsystem to create the timing of the change of the clock frequency.

2. A method according to claim 1, wherein modify the state of the output subsystem comprises:

modifying the state of the output subsystem after one or more cycles.

3. A method according to claim 2, wherein the modifying the state of the output subsystem comprises:

if the output of the output subsystem does not contain a predetermined sequence during the one or more cycles, modifying the output of the subsystem after the one of more cycles.

4. A method according to claim 1, wherein the monitoring an event comprising:

monitoring an internal event trigger affecting the clock frequency; and/or monitoring an external event trigger affecting the clock frequency.

5. A method according to claim 1, wherein synchronize the timing of the change of the clock frequency comprises:

determining the timing of the change of the clock frequency.

6. A method according to claim 1, wherein the output subsystem comprises:

a modulator operating based on a modulator clock derived from the system clock and having N output states (N>1), and an output driver driven based on the output state of the modulator, and wherein modify the state of the output subsystem comprises:

forcing or injecting a null state in the modulator or the output driver; and subsequently restoring an original amount of energy.

7. A method according to claim 6, wherein the output driver operates in a 2-state operation without the null state in a normal mode, the forcing or injecting a null state comprising:

controlling the output driver to operate in a 3-state operation having the null state.

8. A method according to claim 6, wherein the forcing or injecting a null state comprises:

in response to the output state of the modulator that goes +V to −V or −V to +V, both being adjacent to each other, forcing at least a part of +V state and a part of −V state to be a null state.

9. A method according to claim 8, wherein the forcing or injecting a null state comprising:

slicing the +V state and the −V state by a clock in phase with the system clock or the system clock, the modulator clock being out of phase from the system clock; and forcing the sliced +V state and the sliced −V state to be null.

10. A system for audio artifact reduction, the system comprising:

a synchronization circuit for monitoring the state of an output subsystem for driving an output transducer based on a system clock, the output transducer for outputting audio sound, and for, in response to an event affecting the frequency of the system clock, synchronizing the timing of the change of the clock frequency based on the state of the output subsystem to reduce or eliminate audio artifacts wherein the synchronizing circuit is configured to perform:

initiating the change of the clock frequency in response to the state of the output subsystem;

in response to the state of the output subsystem indicating possible audio artifacts, modifying the state of the output subsystem to create the timing of the change of the clock frequency.

11. A system according to claim 10, wherein the output subsystem generates a series of pulses by alternating between 2 states, 3 states or more than 3 states.

12. A system according to claim 10, wherein the output subsystem comprises:

a modulator operating based on a modulator clock derived from the system clock and having N output states (N>1), and an output driver driven based on the output state of the modulator, wherein the synchronization circuit is configured to perform:

forcing or injecting a null state in the modulator or the output driver to create the timing of the change of the clock frequency; and subsequently restoring the original amount of energy.

13. A system according to claim 12, wherein the modulator operates based on the modulator clock to process audio data, the audio data being provided to the modulator based on the instruction of a DSP operating a DSP clock derived from the system clock.

14. A system according to claim 12, wherein the output driver is an H bridge circuit, or wherein the output driver operates without the null state in a normal mode and the synchronization circuit controls the output driver to operate with the null state.

15. A system according to claim 12, wherein the synchronization circuit is configured to perform:

in response to the output state of the modulator that goes +V to −V or −V to +V, both being adjacent to each other, forcing at least a part of +V state and a part of −V state to be a null state.

16. A system according to claim 15, wherein the modulator clock is out of phase from the system clock, and wherein the synchronization circuit is configured to perform:

forcing the at least a part of +V state and a part of −V state to be a null state for one or less than one clock period of the system clock by slicing the +V state and the −V state by a clock in phase with the system clock or the system clock.

17. A system according to claim 10, wherein the synchronization circuit is implemented by a digital based scheme, and wherein the system is a hearing aid including an oscillator for generating the DSP clock and the modulator clock.

18. A computer readable non-transitory storage medium storing one or more programs, the one or more programs comprising instructions, which when executed, cause a system to perform a method of improving quality of audio sound, the method of the one or more programs includes:

monitoring a state of an output subsystem for driving an output transducer based on a system clock, the output transducer for outputting audio sound;

monitoring an event affecting the frequency of the clock; and in response to the event, synchronizing the timing of a clock frequency change event for changing the clock frequency, based on the state of the output subsystem to reduce or eliminate audio artifacts including initiating the change of the clock frequency in response to the state of the output subsystem, and in response to the state of the output subsystem indicating possible audio artifacts, modifying the state of the output subsystem to create the timing of the clock frequency change.

* * * * *